US007669415B2

(12) United States Patent
Komaki et al.

(10) Patent No.: US 7,669,415 B2
(45) Date of Patent: Mar. 2, 2010

(54) EXTERNAL COMBUSTION ENGINE

(75) Inventors: Katsuya Komaki, Kariya (JP); Shinichi Yatsuzuka, Nagoya (JP); Yasunori Niiyama, Kuwana (JP)

(73) Assignee: Denso Corporation, Kariya (JP)

( * ) Notice: Subject to any disclaimer, the term of this patent is extended or adjusted under 35 U.S.C. 154(b) by 12 days.

(21) Appl. No.: 12/011,585

(22) Filed: Jan. 28, 2008

(65) Prior Publication Data

US 2008/0282701 A1 Nov. 20, 2008

(30) Foreign Application Priority Data

May 17, 2007 (JP) ..... 2007-131262

(51) Int. Cl.
*F02G 1/04* (2006.01)
*F01K 23/06* (2006.01)
*F02C 5/00* (2006.01)

(52) U.S. Cl. ..... 60/531; 60/508; 60/516; 60/670; 60/39.6

(58) Field of Classification Search ..... 60/508, 60/514, 517, 531, 659, 670, 516–526; 138/26, 138/30, 31
See application file for complete search history.

(56) References Cited

U.S. PATENT DOCUMENTS 4,489,553 A * 12/1984 Wheatley et al. ..... 60/516
4,584,840 A * 4/1986 Baumann ..... 62/6
5,927,071 A * 7/1999 Asanuma et al. ..... 60/396
6,474,058 B1 * 11/2002 Warren ..... 60/39.6
6,497,940 B1 * 12/2002 Valentini et al. ..... 428/32.25
6,931,582 B2 * 8/2005 Tamura et al. ..... 714/758
6,973,788 B2 * 12/2005 Oda et al. ..... 60/645
6,976,360 B1 * 12/2005 Yatsuzuka et al. ..... 60/645
7,415,824 B2 * 8/2008 Komaki et al. ..... 60/508
2004/0060294 A1 4/2004 Yatsuzuka et al.
2005/0257524 A1 11/2005 Yatsuzuka et al.
2005/0257525 A1 * 11/2005 Komaki et al. ..... 60/670
2007/0220888 A1 9/2007 Komaki et al.

FOREIGN PATENT DOCUMENTS

JP 2004-84523 3/2004
JP 2005-330883 12/2005
JP 2005-330885 12/2005
JP 2007-255259 10/2007

* cited by examiner

*Primary Examiner*—Thomas E Denion
*Assistant Examiner*—Christopher Jetton
(74) *Attorney, Agent, or Firm*—Harness, Dickey & Pierce, PLC

(57) ABSTRACT

An external combustion engine provided with a plurality of evaporators and stabilized in output and efficiency, that is, an engine provided with at least one main container, a plurality of evaporators heating the working medium to evaporate, condensers cooling the vapor of the working medium evaporated at the evaporators to make it condense, an output part communicated with the other end of the main container and converting displacement of a liquid part of the working medium occurring due to fluctuations in volume of the working medium accompanying evaporation and condensation of the working medium to mechanical energy for output, a single main container pressure adjusting means adjusting an internal pressure of the main container, and controlling means for controlling the main container pressure adjusting means based on a lowest temperature in the temperatures of the plurality of evaporators constituting a minimum evaporator temperature.

7 Claims, 8 Drawing Sheets

EXTERNAL COMBUSTION ENGINE

BACKGROUND OF THE INVENTION

1. Field of the Invention

The present invention relates to an external combustion engine using evaporation and condensation of a working medium to displace a liquid part of the working medium and converting the displacement of the liquid part of the working medium to mechanical energy for output.

2. Description of the Related Art

In the past, this type of external combustion engine is also called a "liquid piston steam engine" and is configured sealing a working medium in a tubular container in the liquid phase state, using an evaporator formed at one end of the container to heat and evaporate part of the liquid phase state working medium, using a condenser formed at the middle of the container to cool the vapor of the working medium to condense it, using this evaporation and condensation of the working medium to cyclically displace a liquid part of the working medium (so-called "self vibration"), and taking out the cyclical displacement of the liquid part of this working medium at the output part as mechanical energy (for example, Japanese Patent Publication (A) No. 2004-84523).

This Japanese Patent Publication (A) No. 2004-84523 describes a so-called "single-cylinder type" liquid piston steam engine where the container as a whole is formed into a single tubular shape.

On the other hand, Japanese Patent Publication (A) No. 2005-330885 describes a so-called "multiple cylinder type" liquid piston steam engine configuring the part of the container from the evaporator to the condenser by a plurality of branched tubes and configuring the remaining part of the container (part at output part side) by a single header tube.

According to the prior art of this Japanese Patent Publication (A) No. 2005-330885, each of the plurality of branched tubes is formed with an evaporator and condenser, so the heat conduction areas of the evaporators and condensers increase. For this reason, the heating performance (evaporation performance) and cooling performance (condensation performance) of the working medium are improved, so the external combustion engine is improved in output.

Note that in the prior art of this Japanese Patent Publication (A) No. 2005-330885, the plurality of evaporators formed at the plurality of branched tubes are arranged in the flow of high temperature gas and use the high temperature gas as a heat source to heat the working medium.

Further, in the prior art of this Japanese Patent Publication (A) No. 2005-330885, a large number of branched tubes are arranged in two perpendicularly intersecting directions so as to reduce the size of the container compared to arranging a large number of branched tubes in just one direction.

In this regard, Japanese Patent Application No. 2006-78802 (hereinafter referred to as the "prior application example") proposes a single cylinder type liquid piston steam engine improving the output and efficiency.

In this prior application example, when the peak value of the internal pressure of the container is lower than the saturated vapor pressure of the working medium at the temperature of the evaporator and becomes a value as close as possible to the saturated vapor pressure (hereinafter referred to as the "ideal peak value"), the external combustion engine becomes highest in output and efficiency (see later explained FIG. 2(*a*)). Considering this, the peak value of the internal pressure of the container can be adjusted by the pressure adjusting means in the container.

Further, if the temperature of the evaporator fluctuates and the saturated vapor pressure of the working medium fluctuates, the pressure adjusting means in the container adjusts the internal pressure of the container in accordance with this and makes the peak value of the internal pressure of the container approach the ideal peak value, so the output and efficiency of the single cylinder type liquid piston steam engine can be maintained high.

Note that the above prior application example describes, as one example of the pressure adjusting means in the container, an auxiliary container type controlling the internal pressure of an auxiliary container separate from the main container in which the working medium is sealed so as to adjust the peak value of the internal pressure of the main container.

More specifically, a working medium is sealed in a liquid state in an auxiliary container communicated with the main container and the working medium in the auxiliary container is compressed or expanded by a piston mechanism, whereby the internal pressure of the auxiliary container is controlled and as a result the peak value of the internal pressure of the main container is adjusted.

Therefore, the inventors studied the multiple cylinder type liquid piston steam engine described in the above Japanese Patent Publication (A) No. 2005-330885 so as to try to improve the output and efficiency using a pressure adjusting means in the container in the same way as the above prior application example.

However, the multiple cylinder type liquid piston steam engine of the above Japanese Patent Publication (A) No. 2005-330885 has the plurality of evaporators arranged in the flow of the high temperature gas, so the more to the upstream side of the high temperature gas the evaporator, the higher the temperature of the evaporator and the more to the downstream side of the high temperature gas the evaporator, the lower the temperature of the evaporator.

For this reason, if deeming the saturated vapor pressure at the temperature of the evaporator at the upstream side of the high temperature gas to be the ideal peak value and adjusting the peak value of the internal pressure of the container, the peak value of the internal pressure of the container will end up exceeding the saturated vapor pressure at the evaporator at the downstream side of the high temperature gas.

As a result, part of the vapor of the working medium ends up condensing at the evaporator at the downstream side of the high temperature gas and minus work ends up being performed, so there is the problem that the output and efficiency end up dropping (see later mentioned FIG. 2(*c*)) and in turn the output and efficiency end up becoming unstable.

In particular, in a system employing the above-mentioned auxiliary container type structure as the pressure adjusting means in the container, the evaporator at the downstream side of the high temperature gas is supplied with too much liquid phase state working medium and the amount of heat exchange at the evaporator ends up increasing, so the temperature of the evaporator ends up dropping. In the worst case, as a result of the temperature of the evaporator dropping, there is the problem that the self vibration of the working medium stops and the output can no longer be obtained.

Note that the inventors studied having a plurality of containers share a single pressure adjusting means in a container for the purpose of lightening the weight and reducing the cost, that is, using a single pressure adjusting means in a container to adjust the peak value of the internal pressure of the plurality of containers, but learned that problems similar to the above occurred when the temperatures of evaporators of a plurality of containers differ from each other.

SUMMARY OF THE INVENTION

The present invention, in consideration of the above point, has as its object to stabilize the output and efficiency in an external combustion engine provided with a plurality of evaporators.

To achieve the above object, the present invention provides an external combustion engine provided with at least one main container formed into a tubular shape and having a working medium sealed flowable in a liquid state; a plurality of evaporators formed at one end side of the main container and heating the working medium to evaporate; condensers formed at the main container at the other end side than the evaporators and cooling the vapor of the working medium evaporated at the evaporators to make it condense; an output part communicated with the other end of the main container and converting displacement of a liquid part of the working medium occurring due to fluctuations in volume of the working medium accompanying evaporation and condensation of the working medium to mechanical energy for output; a single main container pressure adjusting means adjusting an internal pressure of the main container; and controlling means for controlling the main container pressure adjusting means based on a lowest temperature in the temperatures of the plurality of evaporators constituting a minimum evaporator temperature.

According to this, the minimum evaporator temperature is used as the basis for control of the main container pressure adjusting means, so at each of the plurality of evaporators, the peak value of the internal pressure of the main container ending up exceeding the saturated vapor pressure can be avoided.

For this reason, at each of the plurality of evaporators, part of the vapor of the working medium condensing and ending up performing minus work and the output and efficiency ending up dropping can be avoided, so the output and efficiency can be stabilized.

Note that the "tubular shaped main container" in the present invention does not mean just that the main container as a whole is shaped as a single tube, but includes one end side of the main container being branched into a plurality of parts.

In the present invention, preferably the engine is further provided with temperature detecting means for detecting the temperatures of the plurality of evaporators, and the controlling means judges a lowest temperature among the temperatures of the plurality of evaporators to be the minimum evaporator temperature.

Further, in the present invention, preferably the plurality of evaporators are arranged in a flow direction of a high temperature fluid and are supplied with heat from the high temperature fluid, and the controlling means uses a temperature of an evaporator arranged at a downstream most side of the high temperature fluid among the plurality of evaporators as the minimum evaporator temperature.

According to this, it is sufficient to detect the temperature of the evaporator arranged at the downstream most side of the high temperature fluid in the plurality of evaporators. There is no need to detect the temperatures of all of the plurality of evaporators, so the structure can be simplified.

Further, in the present invention, preferably the engine is further provided with a heat source supplying heat to the plurality of evaporators and thermal connecting means for thermally connecting the plurality of evaporators, and the controlling means uses a temperature of an evaporator with a greatest thermal resistance due to the thermal connecting means among the plurality of evaporators as the minimum evaporator temperature.

According to this, it is sufficient to detect the temperature of the evaporator with the greatest thermal resistance due to the thermal connecting means in the plurality of evaporators. There is no need to detect the temperatures of all of the plurality of evaporators, so the structure can be simplified.

Further, in the present invention, preferably the main container (10) has a plurality of branched tubes at the other end side of the one end side from the header tube, and the evaporators are formed at the plurality of branched tubes.

Due to this, the above-mentioned effects of the present invention can be exhibited in a so-called "multiple cylinder type liquid piston steam engine".

Further, in the present invention, preferably there are a plurality of the main containers, the evaporators are formed at the plurality of main containers, and internal pressures of the plurality of main containers are adjusted by the single pressure adjusting means in the main containers.

Due to this, the above-mentioned effects of the present invention can be exhibited in a liquid piston steam engine where a plurality of main containers share a single main container pressure adjusting means.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

First Embodiment

Below, a first embodiment of the present invention will be explained based on FIG. 1 to FIG. 5. The external combustion engine according to the present invention is also called a "liquid piston steam engine". This embodiment applies the liquid piston steam engine according to the present invention to a generator system.

Figure 1:
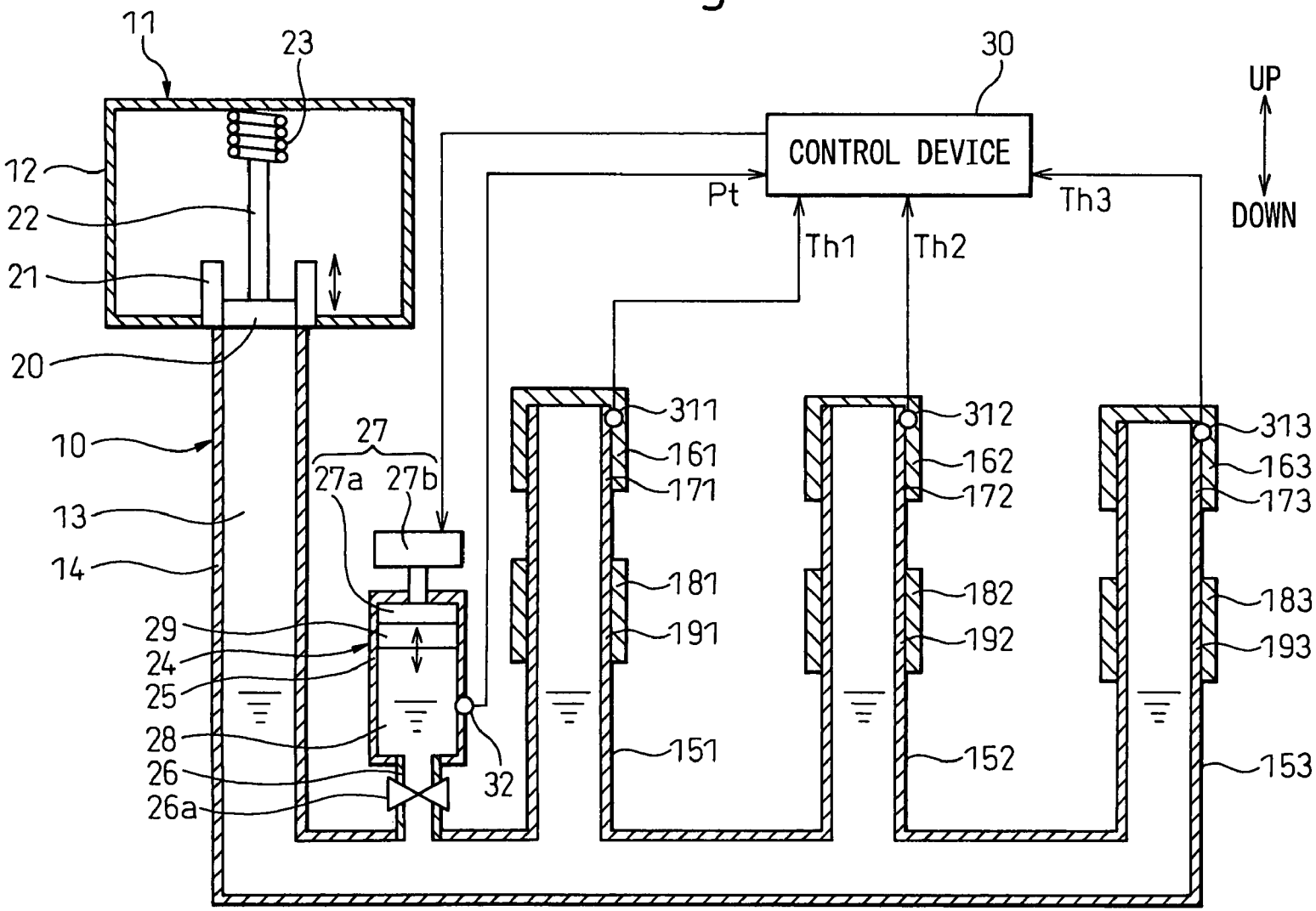
FIG. 1 is a schematic view of the configuration of a liquid piston steam engine showing a first embodiment of the present invention.

FIG. 1 is a view showing the schematic configuration of the liquid piston steam engine according to this embodiment. The up and down arrows in FIG. 1 show the up-down direction in the state of installation of the liquid piston steam engine. The liquid piston steam engine according to this embodiment has a main container 10 and a generator 11 forming an output part. The generator 11 has a casing 12 in which a movable element (not shown) having permanent magnets embedded in it is stored and generates electromotive force by vibration and displacement of the movable element.

The main container 10 is a pressure container mainly formed into a tubular shape and having a working medium (in this example, water) 13 sealed in it flowable in a liquid state and has a single header tube 14 connected to the generator 11 and mutually parallel first to third branched tubes 151 to 153 branched from the header tube 14.

The header tube 14 extends downward from the generator 11 and is bent at its middle part toward the horizontal direction to form an L-shape. First to third branched tubes 151 to 153 extend upward from the part of the header tube 14 extending in the horizontal direction.

In this example, the first branched tube 151 is arranged at the side closest to the generator 11, while the third branched tube 153 is arranged at the side furthest from the generator 11. Further, the header tube 14 and the first to third branched tubes 151 to 153 are formed into tubular shapes from stainless steel.

At the outer peripheries of the top ends of the first to third branched tubes 151 to 153, the first to third heaters 161 to 163 are arranged in contact in heat conductible manners. The first to third heaters 161 to 163 in this example exchange heat with high temperature gas (for example, exhaust gas of automobiles), but the first to third heaters 161 to 163 may also be made electric heaters.

The parts of the first to third branched tubes 151 to 153 contacting the first to third heaters 161 to 163 form first to third evaporators 171 to 173 heating and evaporating part of the liquid phase state working medium 13. Note that the first to third evaporators 171 to 173 correspond to the "plurality of evaporators" in the present invention.

By the first to third heaters 161 to 163 exchanging heat with the high temperature gas, the working medium 13 in the first to third evaporators 171 to 173 is heated through the first to third evaporators 171 to 173.

At the outer peripheries of the middle parts of the first to third branched tubes 151 to 153 in the longitudinal direction (vertical direction in FIG. 1), first to third coolers 181 to 183 in which cooling water is circulated are arranged in contact in heat conductible manners. The parts of the first to third branched tubes 151 to 153 contacting the first to third coolers 181 to 183 form first to third condensers 191 to 193 cooling and condensing the working medium 13 by the first to third evaporators 171 to 173.

By circulating cooling water to the first to third coolers 181 to 183, the working medium in the first to third condensers 191 to 193 is cooled through the first to third condensers 191 to 193.

In the circulating circuit of the cooling water circulating through the first to third coolers 181 to 183, a radiator (not shown) is arranged. Due to this, the heat which the cooling water robs from the vapor of the working medium 13 is radiated by the radiator into the atmosphere.

Note that first to third evaporators 171 to 173 and first to third condensers 191 to 193 may also be formed by copper or aluminum superior in heat conductivity coefficients.

On the other hand, inside the casing 12 of the generator 11, a piston 20 displacing upon receiving pressure from the liquid part of the working medium 13 is arranged slidable with respect to the cylinder part 21. Note that the piston 20 is connected to a shaft 22. The end of the shaft 22 at the opposite side from the piston 20 is provided with a coil spring 23 generating an elastic force so as to push back the once pushed out piston 20. Note that shaft 22 has the above-mentioned movable element (not shown) coupled with it. By the shaft 22 vibrating and displacing, the movable element also vibrates and displaces.

In this example, as a main container pressure adjusting mechanism 24 for adjusting the internal pressure Pc of the main container 10 (hereinafter referred to as the "main container internal pressure"), a mechanism of the auxiliary container type adjusting the main container internal pressure Pc by controlling the internal pressure Pt of the auxiliary container 25 (hereinafter referred to as the "auxiliary container internal pressure") is employed. Specifically, the main container pressure adjusting mechanism 24 is comprised of an auxiliary container 25, connecting pipe 26, and pressure adjusting piston mechanism 27.

The auxiliary container 25 is communicated through the connecting pipe 26 with the main container 10. More specifically, the auxiliary container 25 is the portion extending in the horizontal direction in the header tube 14 and is communicated with the generator 11 side before the first branched tube 151. In this example, the auxiliary container 25 is arranged above the header tube 14.

The auxiliary container 25 is filled with a pressure adjusting liquid 28 and gas 29. The pressure adjusting liquid 28 corresponds to the "liquid" of the present invention. In this example, the pressure adjusting liquid 28 is made water in the same way as the working medium 13.

As the gas 29, it is preferable to use a gas insoluble in the pressure adjusting liquid 28. In this example, as the gas 29, helium insoluble in water is used. Note that the auxiliary container 25 may also be filled with only the pressure adjusting liquid 28.

The auxiliary container 25 and connecting pipe 26 are preferably made from materials superior in heat insulating property, but in this embodiment, the pressure adjusting liquid 28 is made water, so the auxiliary container 25 and connecting pipe 26 are made from stainless steel.

The connecting pipe 26 is formed with a constricted part 26*a* reducing the size of the flow passage. This constricted part 26*a* suppresses fluctuations of the internal pressure Pt of the auxiliary container 25 following cyclical fluctuations of the main container internal pressure Pc. The average value Pca of the main container internal pressure Pc stabilizes at a pressure substantially equal to the auxiliary container internal pressure Pt.

The pressure adjusting piston mechanism 27 forms a pressure adjusting means inside the auxiliary container adjusting the auxiliary container internal pressure Pt and is comprised of a pressure adjusting piston 27*a* and an electric actuator 27*b* driving the pressure adjusting piston 27*a*.

The pressure adjusting piston 27*a* is arranged at the top end inside the auxiliary container 25, while the electric actuator 27*b* is arranged above the auxiliary container 25. Further, the pressure adjusting piston 27*a* is designed to be moved reciprocating inside the auxiliary container 25 in the vertical direction.

Next, explaining the outline of the electronic control unit in this embodiment, the control device 30 is comprised of a known microcomputer comprised of a CPU, ROM, RAM, etc. and its peripheral circuits and corresponds to the "controlling means" in the present invention.

The control device 30 receives as input detection signals for control of the pressure adjusting piston mechanism 27 from first to third evaporator temperature sensors 311 to 313 detecting the temperatures (hereinafter referred to as the "first to third evaporator temperatures") Th1 to Th3 of the first to third evaporators 171 to 173 and from an auxiliary container internal pressure sensor 32 detecting the auxiliary container internal pressure Pt. The control device 30 is designed to control the drive operation of the electric actuator 27*b* based on the detection signals from the sensors 311 to 313 and 32.

Next, the operation in the above configuration will be explained. If the first to third heaters 161 to 163 and first to third coolers 181 to 183 are operated, first the first to third heaters 161 to 163 heat and evaporate the working medium 13 in the liquid phase state of the first to third evaporators 171 to 173, the first to third evaporators 171 to 173 store the vapor of the high temperature, high pressure working medium 13, and the liquid surfaces of the working medium 13 of the first to third branched tubes 151 to 153 are pushed down. This being the case, the liquid part of the working medium 13 displaces to the piston 20 side and pushes up the piston 20. At this time, the coil spring 23 is elastically compressed.

Further, the liquid surfaces of the working medium 13 in the first to third branched tubes 151 to 153 fall to the first to third condensers 191 to 193. When the vapor of the working medium 13 enters the first to third condensers 191 to 193, the vapor of this working medium 13 is cooled by the first to third coolers 181 to 183 and condensed, so the forces pushing down the liquid surfaces of the working medium 13 in the first to third branched tubes 151 to 153 are eliminated.

This being the case, the piston 20 at the generator 11 side pushed up once by the expansion of the vapor of the working medium 13 descends due to the elastic recovery force of the coil spring 23, then the liquid part of the working medium 13 displaces to the first to third evaporator 171 to 173 sides. Further, the liquid surfaces of the working medium 13 in the first to third branched tubes 151 to 153 rise to the first to third evaporators 171 to 173.

Further, this operation is repeatedly executed until stopping the operations of the first to third heaters 161 to 163 and first to third coolers 181 to 183. During that time, the working medium 13 in the main container 10 cyclically displace (so-called "self vibration") and make the not shown movable element of the generator 11 move up and down.

That is, by alternately repeating the generation of vapor and condensation of the working medium 13, the liquid part of the working medium 13 displaces like a piston. For this reason, the liquid part of the working medium 13 functions as a liquid piston and the displacement of this liquid piston is taken out as output. For this reason, the external combustion engine according to the present invention can also be called a "liquid piston steam engine".

Here, the relationship between the peak value Pc1 of the main container internal pressure Pc and the performance of the liquid piston steam engine (output and efficiency) will be explained. Note that here, for simplification of the explanation, the explanation will be given assuming the temperatures of the first to third evaporators 171 to 173 are the same.

Figure 2A:
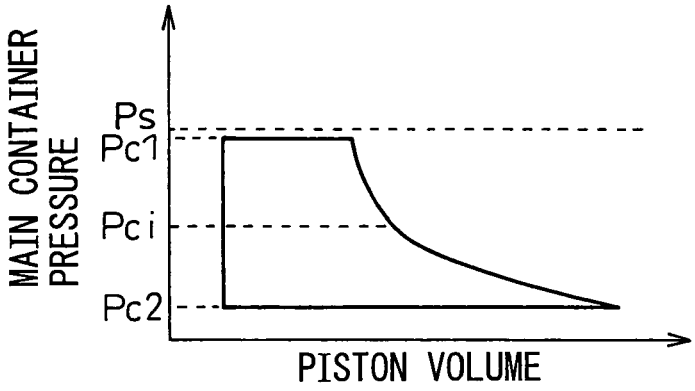
FIG. 2 is a PV graph of an external combustion engine of the first embodiment, wherein (a) shows an ideal-like state, (b) shows a state where the peak value of the main container internal pressure is lower than a saturated vapor pressure, and (c) shows a state where the peak value of the main container internal pressure is higher than the saturated vapor pressure.
Figure 2B:
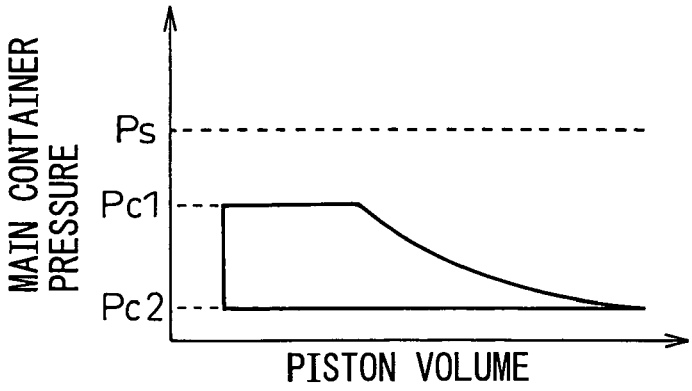
Figure 2C:
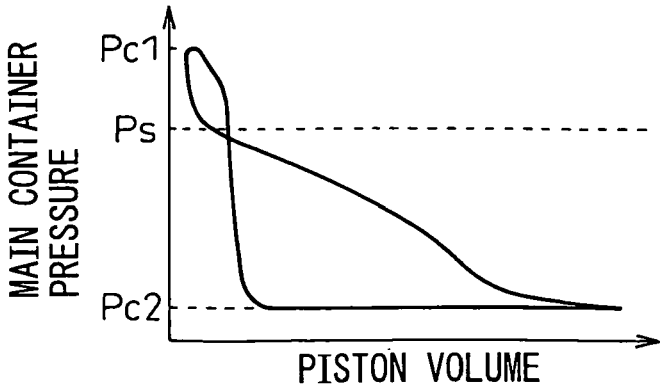

FIG. 2(*a*) shows a PV graph in one state of the liquid piston steam engine. The abscissa of this PV graph shows the volume of the space defined by the main container 10, cylinder part 21, and piston 20 (hereinafter referred to as the "piston volume"). This piston volume fluctuates along with the reciprocating motion of the piston 20. The same is true for the abscissas of the PV graphs shown in the later mentioned FIGS. 2(*b*) and (*c*).

FIG. 2(*a*) is a PV graph in the state where the peak value Pc1 of the main container internal pressure Pc is lower than the saturated vapor pressure Ps of the working medium 13 of the evaporator temperature and a value as close as possible to the saturated vapor pressure Ps (hereinafter referred to as the "ideal peak value").

This state is the ideal state where the amount of work of the liquid piston steam engine per cycle becomes largest and the liquid piston steam engine becomes highest in performance (output and efficiency). Note that the Pci shown in FIG. 2(*a*) is the average value of the main container internal pressure Pc in this ideal-like state (hereinafter referred to as the "ideal average value"). Here, the "average value Pca of the main container internal pressure P" means the average value Pca of the main container internal pressure Pc while the working medium 13 is self vibrating for one cycle.

On the other hand, FIG. 2(*b*) is a PV graph when the peak value Pc1 is remarkably lower than the saturated vapor pressure Ps. In this state, the amount of work per cycle becomes smaller, so the liquid piston steam engine drops in performance (output and efficiency).

Further, FIG. 2(*c*) is a PV graph when the peak value Pc1 is higher than the saturated vapor pressure Ps. In this state, the peak value Pc1 becomes higher than the saturated vapor pressure Ps, so part of the vapor of the working medium 13 ends up condensing. For this reason, minus work ends up being performed, so the liquid piston steam engine ends up dropping in performance (output and efficiency).

Figure 3:
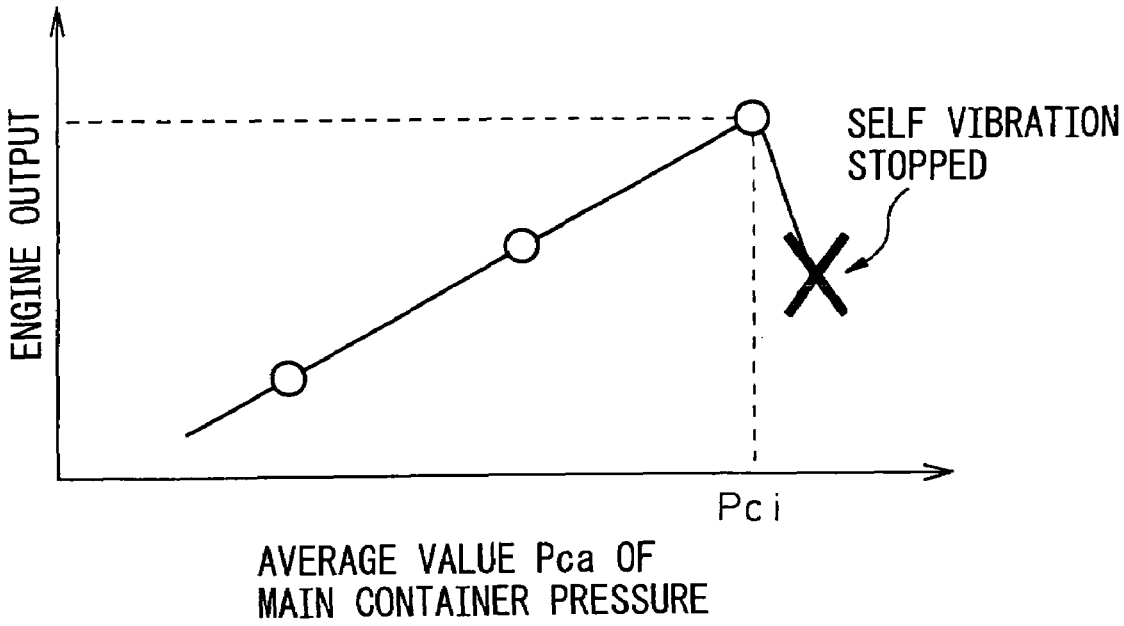
FIG. 3 is a graph showing the average value of the main container internal pressure and the output of the liquid piston steam engine.

FIG. 3 graphs the relationship between the average value Pca of the main container internal pressure Pc and the output of the liquid piston steam engine. Here, "the average value Pca of the main container internal pressure Pc" means the average value Pca of the main container internal pressure Pc while the working medium 13 is self vibrating for one cycle. Note that the relationship of the average value Pca of the main container internal pressure Pc and the efficiency of the liquid piston steam engine is similar to FIG. 3, so illustration will be omitted.

As will be understood from FIG. 3, to draw out to the maximum the performance of the liquid piston steam engine (output and efficiency), the average value Pca of the main container internal pressure Pc should be constantly maintained at the ideal average value Pci.

Therefore, if the temperature of the high temperature gas serving as the heat source of the heater fluctuates, the evaporator temperature fluctuates and the saturated vapor pressure Ps of the working medium 13 ends up fluctuating, so the ideal average value Pci also ends up fluctuating.

Therefore, this embodiment adjusts the main container internal pressure Pc in accordance with fluctuation of the evaporator temperature so as to make the average value Pca of the main container internal pressure Pc constantly approach the ideal average value Pci and in turn stably draw out the performance of the liquid piston steam engine.

More specifically, by making the average value Pca of the main container internal pressure Pc approach the target value Pc0 similar to the ideal average value Pci, the average value Pca of the main container internal pressure Pc is made to constantly approach the ideal average value Pci.

Figure 4:
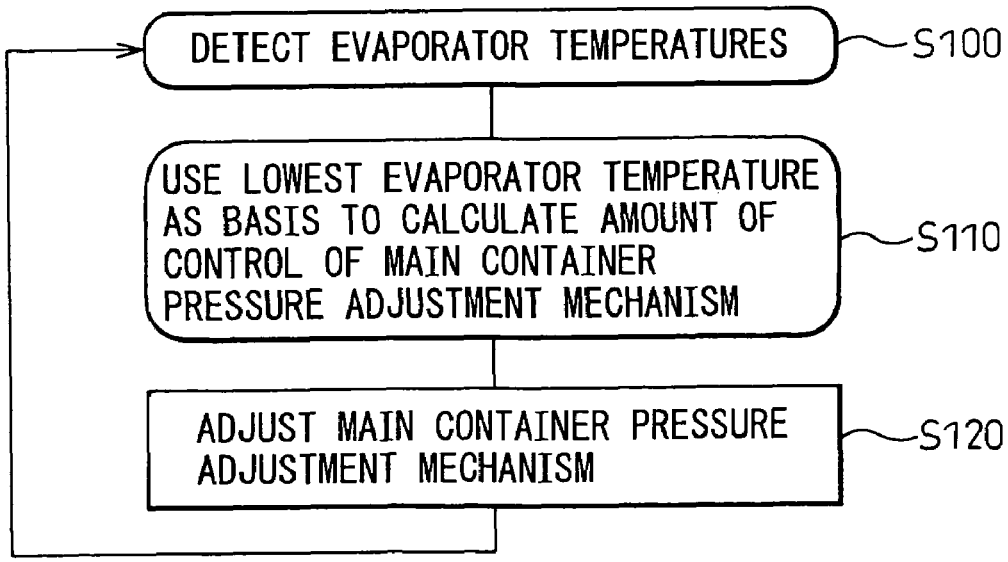
FIG. 4 is a flow chart showing a summary of the control in the first embodiment.

FIG. 4 is a flow chart showing an outline of the control of the main container internal pressure Pc executed by the control device 30. First, at step S100, the first to third evaporator temperatures Th1 to Th3 detected by the first to third evaporator temperature sensors 311 to 313 are read. Next, at step S110, the lowest temperature among the first to third evaporator temperatures Th1 to Th3 (hereinafter referred to as the "minimum evaporator temperature") Thmin is used as a basis for calculating the amount of control of the pressure adjusting mechanism 24 in the main container, more specifically the amount of control of the pressure adjusting piston 27*a*.

Here, specifically explaining the method of calculation of the amount of control of the pressure adjusting piston 27*a* at step S110, first the control device 30 judges the lowest temperature among the first to third evaporator temperatures Th1 to Th3 read from the first to third evaporator temperature sensors 311 to 313 to be the minimum evaporator temperature Thmin.

Next, the minimum evaporator temperature Thmin and the vapor pressure curve of the working medium 13 stored in the control device 30 are used as the basis to calculate the saturated vapor pressure Psmin of the working medium 13 at the minimum evaporator temperature Thmin.

Next, the average value of the saturated vapor pressure Psmin of the working medium 13 at the minimum evaporator temperature Thmin and the minimum value Pc2 in one cycle of the main container internal pressure Pc (see FIG. 2) is calculated and this average value is used as the target value Pc0.

Here, the minimum value Pc2 in one cycle of the main container internal pressure Pc is substantially the same as the atmospheric pressure (0.1 MPa), so in this example the atmospheric pressure (0.1 MPa) is used as the minimum value Pc2 in one cycle of the main container internal pressure Pc.

Note that as the target value Pc0, the suitably corrected average value of the saturated vapor pressure Psmin of the working medium 13 of the minimum evaporator temperature Thmin and the atmospheric pressure (0.1 MPa) may be used. Further, as the minimum value Pc2 in one cycle of the main container internal pressure Pc, instead of the atmospheric pressure (0.1 MPa), the saturated vapor pressure of the working medium 13 at the lowest condenser temperature among the temperatures of the first to third condensers 191 to 193 may also be used.

Further, when the auxiliary container internal pressure Pt is lower than the target value Pc0, the amount of control of the pressure adjusting piston 27*a* is calculated so as to push out the pressure adjusting piston 27*a*. On the other hand, when the auxiliary container internal pressure Pt is higher than the target value Pc0, the amount of control of the pressure adjusting piston 27*a* is calculated so as to pull back the pressure adjusting piston 27*a*.

Further, at step S120, the amount of control calculated at step S110 is used as the basis to control the pressure adjusting piston 27*a*. More specifically, when the auxiliary container internal pressure Pt is lower than the target value Pc0, the electric actuator 27*b* pushes out the pressure adjusting piston 27*a* to reduce the volume of the auxiliary container 25. Due to this, the pressure adjusting liquid 28 is compressed and the auxiliary container internal pressure Pt rises.

On the other hand, when the auxiliary container internal pressure Pt is higher than the target value Pc0, the pressure adjusting piston 27*a* is pulled back to decrease the volume of the auxiliary container 25. Due to this, the pressure adjusting liquid 28 expands and the auxiliary container internal pressure Pt drops.

This being the case, the average value Pca of the main container internal pressure Pc also follows the auxiliary container internal pressure Pt, so the average value Pca of the main container internal pressure Pc approaches the target value Pc0. In other words, the average value Pca of the main container internal pressure Pc approaches the ideal average value Pci.

As a result, the peak value Pc1 of the main container internal pressure Pc can constantly be made to approach the ideal peak value, so the operating state of the liquid piston steam engine can constantly be made to approach the ideal-like state and in turn the effects of fluctuation of the evaporator temperature can be eliminated and the performance of the liquid piston steam engine can be stably drawn out.

Figure 5:
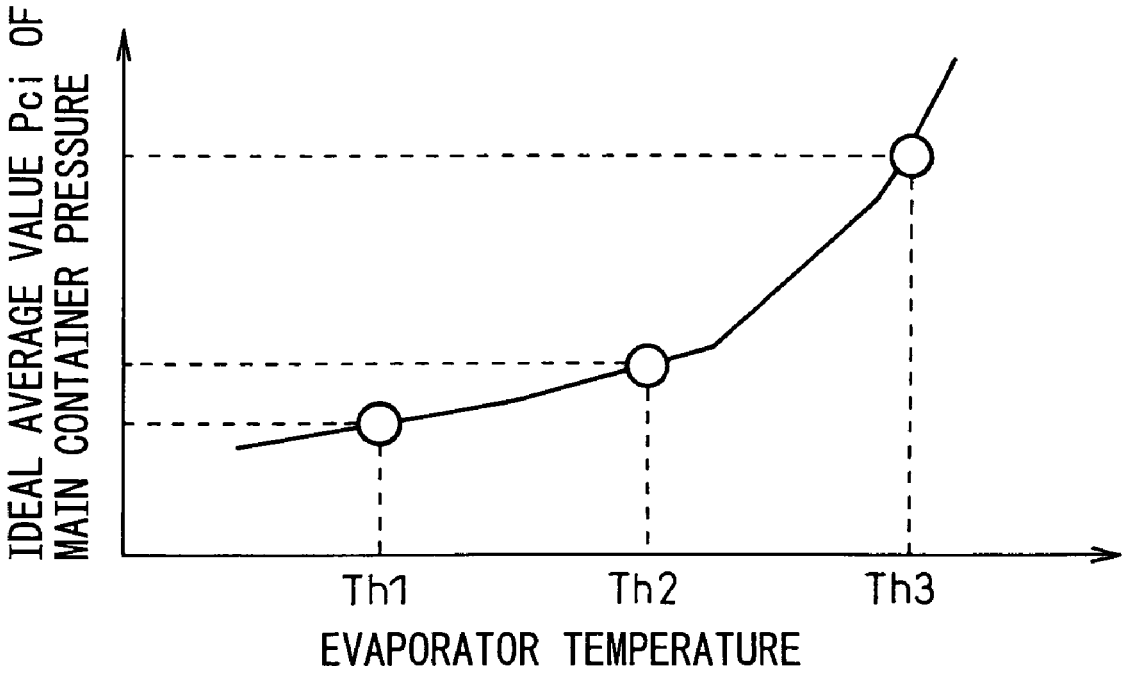
FIG. 5 is a graph showing the relationship between the evaporator temperature and the ideal average value of the main container internal pressure.

However, FIG. 5 is a graph showing the relationship between the evaporator temperature and ideal average value Pci. Note that FIG. 5 shows an example of the detection values of the first to third evaporator temperatures Th1 to Th3.

The higher the evaporator temperature, the higher the saturated vapor pressure Ps of the working medium 13, so the higher the evaporator temperature, the higher the ideal average value Pci. For this reason, as shown in the example of the detection value shown in FIG. 5, when the first to third evaporator temperatures Th1 to Th3 differ from each other, the ideal average values Pci corresponding to the first to third evaporator temperature Th1 to Th3 also differ from each other.

As a result, when the first to third evaporator temperatures Th1 to Th3 differ from each other, the question becomes which of the first to third evaporator temperatures Th1 to Th3 to use as a basis to calculate the target value Pc0. The inventors obtained the following discovery through detailed studies.

That is, for example, in the example of the detection values shown in FIG. 5, the saturated vapor pressures Ps2 and Ps3 of the working medium 13 at the second and third evaporator temperatures Th2 and Th3 are larger than the saturated vapor pressure Ps1 of the working medium 13 at the first evaporator temperature Th1, so the target value calculated based on either of the second and third evaporator temperatures Th2 and Th3 becomes larger than the target value calculated based on the first evaporator temperature Th1.

Therefore, if using either of the second and third evaporator temperatures Th2 and Th3 as the basis for calculating the target value Pc0 and controlling the pressure adjusting piston 27*a*, the peak value Pc1 of the main container internal pressure Pc ends up exceeding the saturated vapor pressure Ps1 at the first evaporator temperature Th1.

In this way, if the peak value Pc1 of the main container internal pressure Pc ends up exceeding the saturated vapor pressure at the first evaporator temperature Th1, as shown in the above-mentioned FIG. 2(*c*), part of the vapor of the working medium 13 in the first evaporator 171 ends up condensing and performing minus work, so the liquid piston steam engine ends up dropping in output and efficiency. As a result, the output and efficiency end up becoming unstable.

In particular, if employing the auxiliary container type structure as the main container pressure adjusting means 24 as in this embodiment, the first evaporator 171 is overly supplied with the liquid phase state working medium 13 and the amount of heat exchange at the first evaporator 171 ends up increasing, so the first evaporator temperature Th1 ends up falling. In the worst case, as a result of the first evaporator temperature Th1 dropping, the self vibration of the working medium 13 stops and the output can no longer be obtained (see FIG. 3).

Therefore, in this embodiment, the minimum evaporator temperature Thmin among the first to third evaporator temperature Th1 to Th3 is used as the basis to calculate the target value Pc0, so the peak value Pc1 of the main container internal pressure Pc ending up exceeding either of the saturated vapor pressures Ps1 to Ps3 at the first to third evaporator temperatures Th1 to Th3 can be avoided. As a result, it is possible to maintain good self vibration of the working medium 13 and possible to stabilize the output and efficiency.

Second Embodiment

Figure 6:
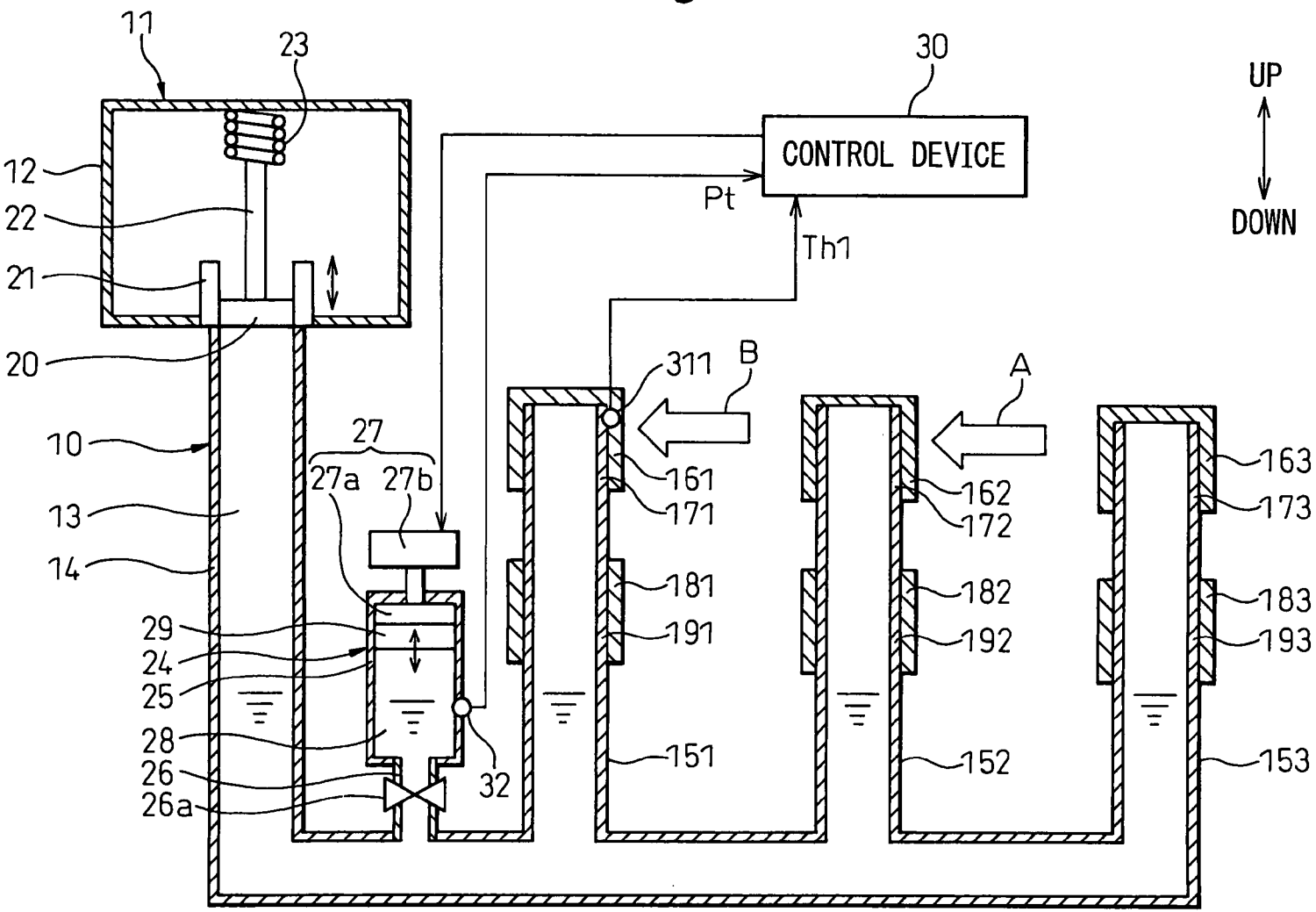
FIG. 6 is a schematic view of the configuration of a liquid piston steam engine showing a second embodiment of the present invention.

In the above first embodiment, the first to third evaporators 171 to 173 are provided with the first to third evaporator temperature sensors 311 to 313, but the second embodiment, as shown in FIG. 6, eliminates the second and third evaporator temperature sensors 312 and 313.

In this embodiment, as shown by the arrow A, the high temperature gas heat exchanged with the third heater 163 flows to the second heater 162 and exchanges heat with the second heater 162. As shown by the arrow B, the high temperature gas heat exchanged with the second heater 162 flows to the first heater 161 and exchanges heat with the first heater 161.

In other words, the first to third evaporators 171 to 173 are arranged in the direction of flow of the high temperature gas. For this reason, the high temperature gas flows from the third evaporator 171 side toward the first evaporator 171 side. Along with this, the temperature of the high temperature gas falls. As a result, the minimum evaporator temperature Thmin constantly becomes the first evaporator temperature Th1 at the downstream most side of the high temperature gas.

Therefore, in this embodiment, the control device 30, at the above-mentioned step S110, uses the first evaporator temperature Th1 as the minimum evaporator temperature Thmin to calculate the amount of control of the pressure adjusting piston 27*a*.

Therefore, just the first evaporator temperature sensor 311 is enough to detect the minimum evaporator temperature Thmin, so the second and third evaporator temperature sensors 312 and 313 can be eliminated.

Third Embodiment

Figure 7:
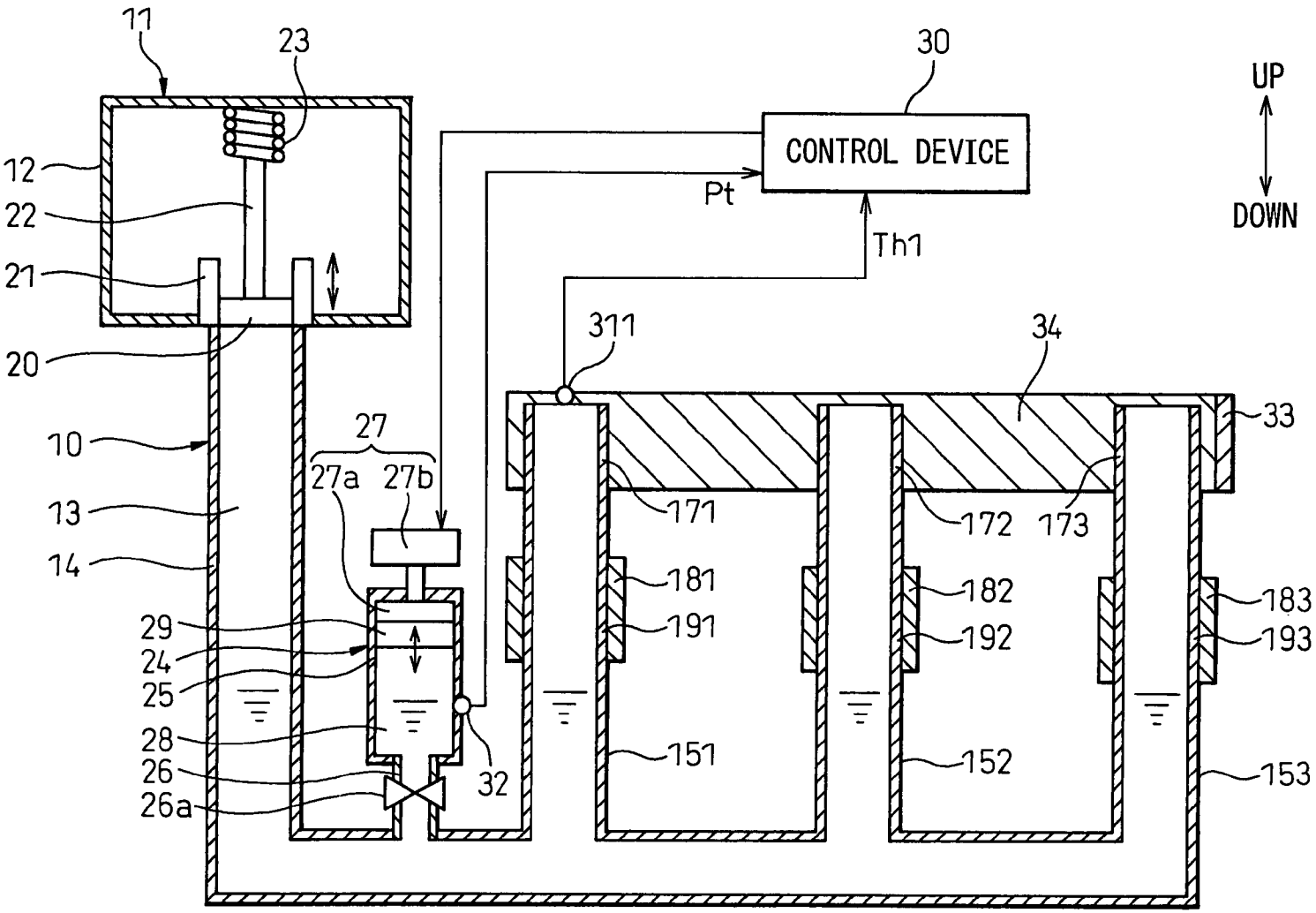
FIG. 7 is a schematic view of the configuration of a liquid piston steam engine showing a third embodiment of the present invention.

In the above second embodiment, the first to third evaporators 171 to 173 were heated by the first to third heaters 161 to 163 respectively, but in the third embodiment, as shown in FIG. 7, the first to third evaporators 171 to 173 are heated by a single heater 33.

More specifically, the first to third evaporators 171 to 173 are thermally connected by the thermal connecting means 34. At the end of the thermal connecting means 34 at the third evaporator 173 side, the heater 33 is arranged in contact in a heat conductible manner. In this embodiment, the thermal connecting means 34 is formed by copper or another material superior in heat conductivity.

By suitably setting the heat conductivity coefficient, heat conduction sectional area, heat conduction distance, etc. of this thermal connecting means 34, the thermal resistances from the heater 33 to the first to third evaporators 171 to 173 become the predetermined values. Here, the "thermal resistance" means the difficulty of transmission of heat. In the case of heat conduction, this determined by the heat conductivity coefficient, sectional area, heat conduction distance, etc., while in the case of heat transfer, this is determined by the heat transfer coefficient, the area, etc.

In this embodiment, the further from the third evaporator 173 to the first evaporator 171, the longer the heat conduction distance from the heater 33, so the thermal resistances from the heater 33 to the first to third evaporators 171 to 173 become larger in the order of the third evaporator 173, second evaporator 172, and first evaporator 171. For this reason, the minimum evaporator temperature Thmin always becomes the first evaporator temperature Th1.

Therefore, in this embodiment, the control device 30, at the above-mentioned step S110, uses the first evaporator temperature Th1 as the minimum evaporator temperature Thmin to calculate the amount of control of the pressure adjusting piston 27*a*.

Therefore, in the same way as the above second embodiment, just the first evaporator temperature sensor 311 is enough to detect the minimum evaporator temperature Thmin, so the second and third evaporator temperature sensors 312, 313 can be eliminated.

Fourth Embodiment

Figure 8:
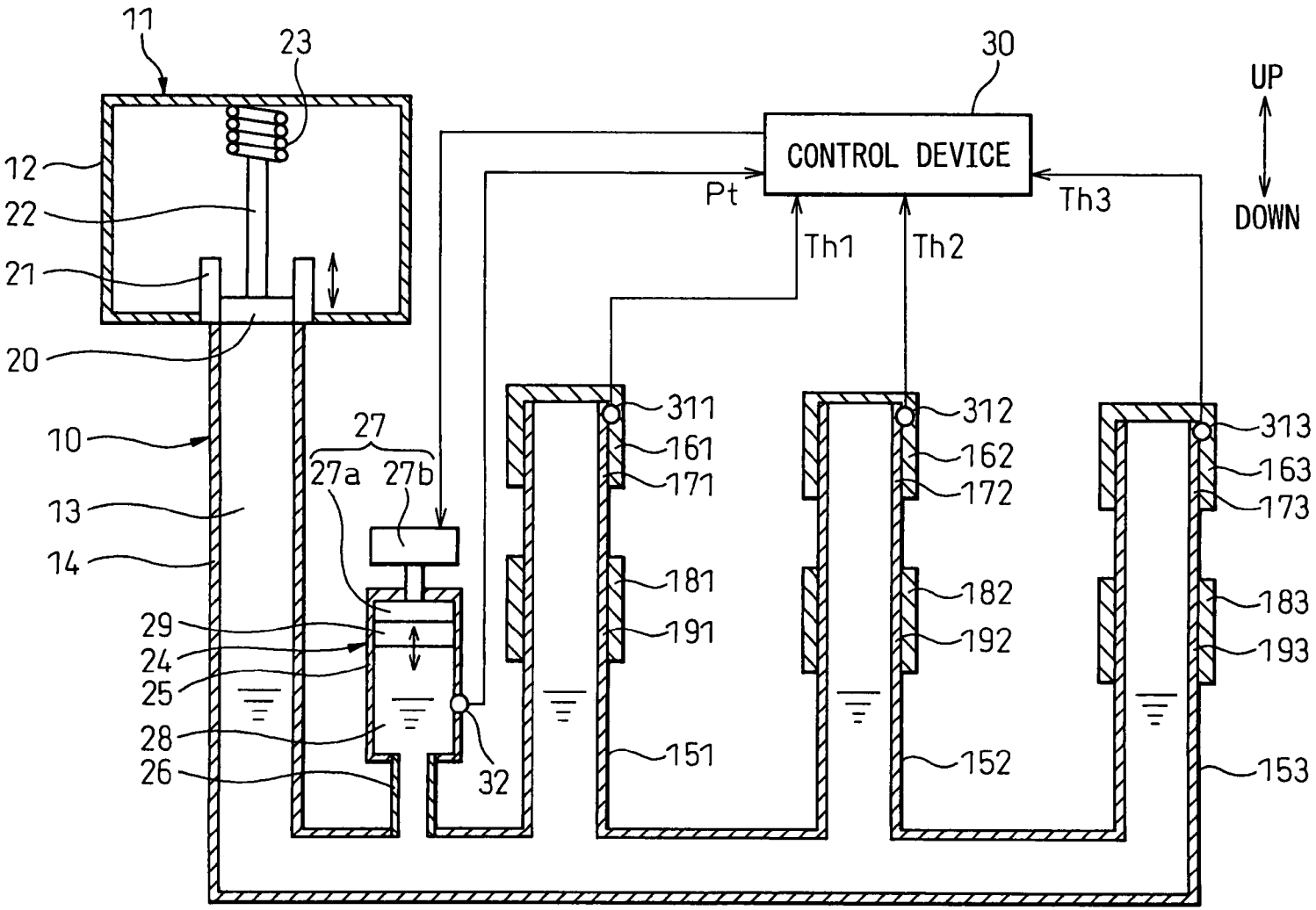
FIG. 8 is a schematic view of the configuration of a liquid piston steam engine showing a fourth embodiment of the present invention.

In the above first embodiment, the connecting pipe 26 is formed with the constricted part 26*a*, but in this fourth embodiment, as shown in FIG. 8, the constricted part 26*a* is eliminated.

In the above first embodiment, as explained above, the connecting pipe 26 is formed with the constricted part 26*a* to stabilize the auxiliary container internal pressure Pt at a pressure substantially equal to the average value Pca of the main container internal pressure Pc. For this reason, by controlling the auxiliary container internal pressure Pt to approach the ideal average value Pci, the main container internal pressure Pc is made to approach the ideal average value Pci and as a result the peak value Pc1 of the main container internal pressure Pc is made to approach the ideal peak value.

On the other hand, in this embodiment, the constricted part 26*a* is eliminated, so the main container internal pressure Pc follows the auxiliary container internal pressure Pt. For this reason, in this embodiment, the peak value Pt1 of the auxiliary container internal pressure Pt is controlled to approach the ideal peak value so as to make the peak value Pc1 of the main container internal pressure Pc approach the ideal peak value.

More specifically, first, in the same way as the above first embodiment, the first to third evaporator temperatures Th1 to Th3 detected by the first to third evaporator temperature sensors 311 to 313 are read, then the minimum evaporator temperature Thmin and the vapor pressure curve of the working medium 13 stored in advance in the control device 30 are used as the basis to calculate the saturated vapor pressure Psmin of the working medium 13 at the minimum evaporator temperature Thmin.

Further, when the peak value Pt1 of the auxiliary container internal pressure Pt is lower than the saturated vapor pressure Psmin, the amount of control of the pressure adjusting piston 27*a* is determined so that the electric actuator 27*b* pushes out the pressure adjusting piston 27*a*. On the other hand, when the peak value Pt1 of the auxiliary container internal pressure Pt is higher than the saturated vapor pressure Ps, the amount of control of the pressure adjusting piston 27*a* is determined so that the electric actuator 27*b* pulls back the pressure adjusting piston 27*a*.

Further, the determined amount of control is used as the basis for control of the pressure adjusting piston 27*a*. More specifically, when the peak value Pt1 of the auxiliary container internal pressure Pt is lower than the saturated vapor pressure Psmin, the electric actuator 27*b* pushes out the pressure adjusting piston 27*a* to decrease the volume of the auxiliary container 25. Due to this, the pressure adjusting liquid 28 is compressed and the auxiliary container internal pressure Pt rises, so the peak value Pt1 of the auxiliary container internal pressure Pt also rises.

On the other hand, when the peak value Pt1 of the auxiliary container internal pressure Pt is higher than the saturated vapor pressure Ps, the electric actuator 27*b* pulls in the pressure adjusting piston 27*a* and increase the volume of the auxiliary container 25. Due to this, the pressure adjusting liquid 28 expands and the auxiliary container internal pressure Pt falls, so the peak value Pt1 also falls.

Here, the main container 10 communicates with the auxiliary container 25 through the connecting pipe 26, so the main container internal pressure Pc follows the auxiliary container internal pressure Pt. For this reason, the peak value Pc1 of the main container internal pressure Pc can be made to approach the saturated vapor pressure Ps of the working medium 13 at the first to third evaporator temperatures Th1 to Th3.

As a result, the operating state of the liquid piston steam engine can be made to constantly approach the ideal-like state, so in the same way as the above first embodiment, it is possible to eliminate the effects of fluctuation of the evaporator temperature and stably draw out the performance of the liquid piston steam engine.

Further, the peak value Pc1 of the main container internal pressure Pc is made lower than the saturated vapor pressure Psmin at the minimum evaporator temperature Thmin in the first to third evaporator temperatures Th1 to Th3 and is made as close to it as possible, so in the same way as the above first embodiment, the peak value Pc1 of the main container internal pressure Pc ending up exceeding one of the saturated vapor pressures Ps1 to Ps3 at the first to third evaporator temperatures Th1 to Th3 can be avoided.

For that reason, in the same way as the above first embodiment, it is possible to maintain good self vibration of the working medium 13 and stabilize the output and efficiency.

Fifth Embodiment

Figure 9:
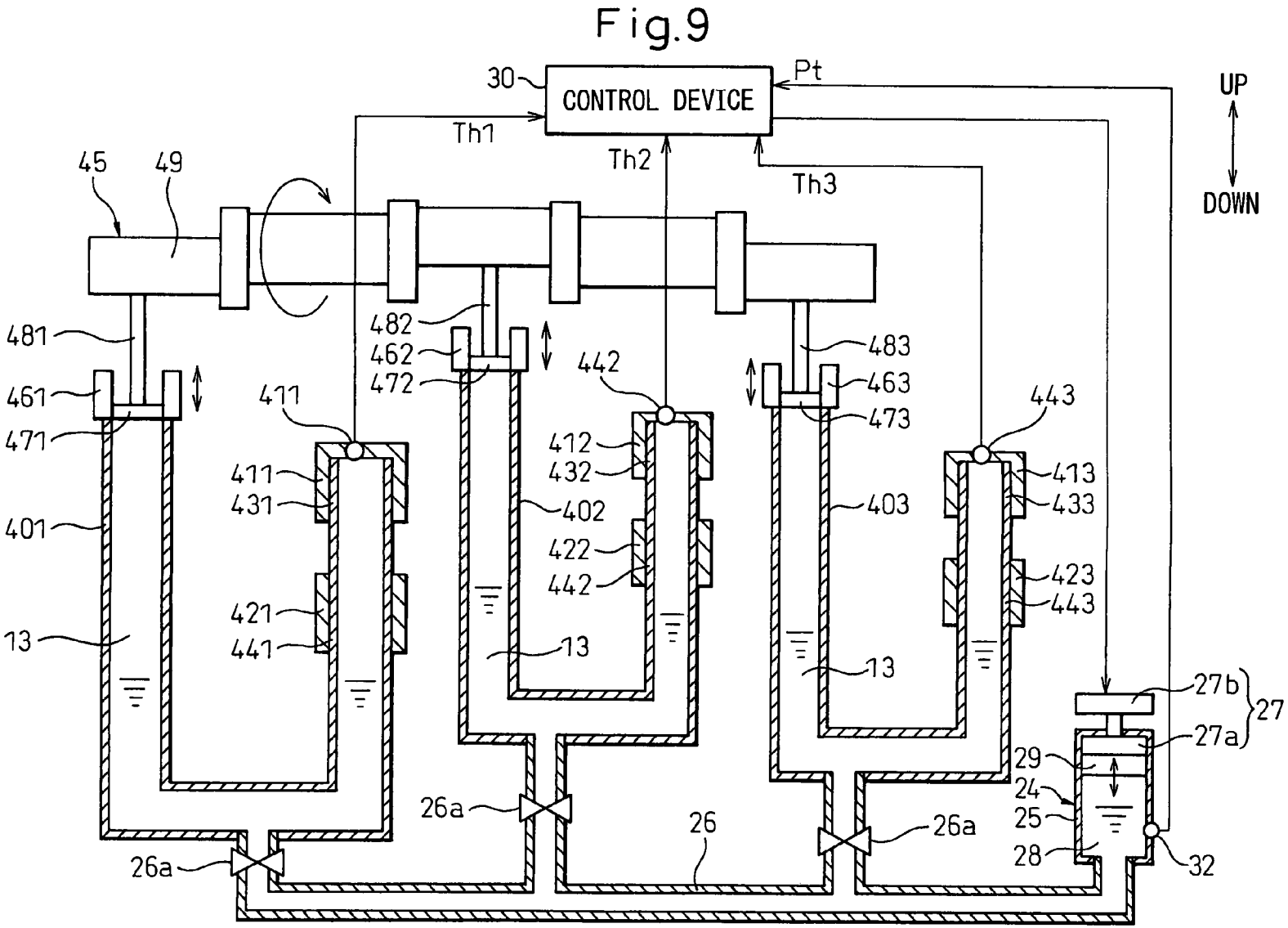
FIG. 9 is a schematic view of the configuration of a liquid piston steam engine showing a fifth embodiment of the present invention.

In the above first embodiment, the present invention was applied to a liquid piston steam engine having just one main container 10, but the fifth embodiment, as shown in FIG. 9, applies the present invention to a liquid piston steam engine having a plurality of main containers.

The liquid piston steam engine of this embodiment has three main containers 401 to 403. The three main containers 401 to 403 are respectively formed overall as single tubular shapes, more specifically, bent U-shapes.

Further, the heaters 411 to 413 are arranged at the ends of the main containers 401 to 403 one to one, while coolers 421 to 423 are arranged at the middle parts of the main containers 401 to 403 one to one. The parts of the main containers 401 to 403 contacting the heaters 411 to 413 form evaporators 431 to 433, while the parts of the main containers 401 to 403 contacting the coolers 421 to 423 form the condensers 441 to 443.

Note that in this embodiment, the evaporator 431 of the first main container 401 is referred to as the "first evaporator", the evaporator 432 of the second main container 402 is referred to as the "second evaporator", and the evaporator 433 of the third main container 403 is referred to as the "third evaporator".

The first to third evaporators 431 to 433 are provided with the first to third evaporator temperature sensors 441 to 443. The detection signals of the first to third evaporator temperature sensors 441 to 443 are input to the control device 30.

The other ends of the main containers 401 to 403 are connected by the output part 45. This output part 45 is comprised of cylinder parts 461 to 463 communicating with the other ends of the main containers 401 to 403, pistons 471 to 473 arranged slidably in the cylinder parts 461 to 463, shafts 481 to 483 coupled with the pistons 471 to 473, and a crankshaft 49 coupling the shafts 481 to 483.

Therefore, the output part 45 can take out the displacement of the liquid pistons at the three main containers 401 to 403 as rotational motion of the crankshaft 49.

The liquid piston steam engine of this embodiment is operated so that the phases of self vibrations of the working medium 13 in the three main containers 401 to 403 are suitably offset. This phase offset is utilized to push back the once pushed out pistons 471 to 473. For this reason, in this embodiment, the coil spring 23 is eliminated.

The main container pressure adjusting mechanism 24 is configured the same as in the above first embodiment, but the three main containers 401 to 403 share a single main container pressure adjusting mechanism 24. That is, the single main container pressure adjusting mechanism 24 is communicated with the three main containers 401 to 403 through the connecting pipe 26. Further, the single main container pressure adjusting mechanism 24 is used to adjust the internal pressure Pc of the three main containers 401 to 403.

More specifically, the lowest evaporator temperature Thmin in the temperatures Th1 to Th3 of the first to third evaporators 431 to 433 is used as the basis for calculating the target value Pc0 of the internal pressure Pc of the three main containers 401 to 403.

Due to this, in each of the three main containers 401 to 403, the peak value Pc1 of the internal pressure Pc ending up exceeding the saturated vapor pressure at the evaporator temperature can be avoided. As a result, in each of the three main containers 401 to 403, a good self vibration of the working medium 13 can be maintained and the output and efficiency can be stabilized.

Note that in this embodiment, the first to third evaporators 431 to 433 are provided with evaporator temperature sensors 441 to 443, but when, like in the above second embodiment, the first to third evaporators 431 to 433 are arranged in the direction of flow of the high temperature gas, just the evaporator at the downstream most side of the high temperature gas among the first to third evaporators 431 to 433 need be provided with an evaporator temperature sensor.

Further, when, like in the above third embodiment, the first to third evaporators 431 to 433 are thermally connected with each other by the thermal connecting means and a single heater is used for heating, just the evaporator with the largest thermal resistance from the heater in the first to third evaporators 431 to 433 need be provided with an evaporator temperature sensor.

Other Embodiments

Note that the main container pressure adjusting means 24 in each of the above embodiments was designed to adjust the volume of the auxiliary container 25 by the pressure adjusting piston mechanism 27, but the invention is not limited to this. In the same way as the above prior application example, various configurations of main container pressure adjusting means can be used. Specifically, instead of the pressure adjusting piston mechanism 27, a pump mechanism adjusting the volume of the pressure adjusting liquid 28 in the auxiliary container 25, a heating means for heating and vaporizing part of the pressure adjusting liquid 28 in the auxiliary container 25, etc. may be used.

Further, in the above embodiments, as the main container pressure adjusting means 24, one of the auxiliary container type controlling the internal pressure Pt of the auxiliary container 25 to adjust the main container internal pressure Pc is employed, but the invention is not limited to the auxiliary container type. In the same way as the above prior application example, ones of various types may be employed. Specifically, as the main container pressure adjusting means 24, one of a type adjusting the volume of the main container 10 itself, one of a type adjusting the temperature of the liquid part of the working medium 13, etc. may be employed.

Further, in the above embodiments, the example of arrangement of three evaporators in a single direction was shown, but like in the above Japanese Patent Publication (A) No. 2005-330885, it is also possible to arrange a large number of evaporators in two perpendicularly intersecting directions.

Further, in the above embodiments, the case of application of the present invention to the drive source of a generator system was explained, but the external combustion engine of the present invention can also be used as a drive source for something other than a generator system.

While the invention has been described with reference to specific embodiments chosen for purpose of illustration, it should be apparent that numerous modifications could be made thereto by those skilled in the art without departing from the basic concept and scope of the invention.

The invention claimed is:

1. An external combustion engine provided with:

at least one main container formed into a tubular shape, a working medium being sealed in a liquid state inside said at least one main container, a plurality of evaporators formed at an upper end side of said main container, the plurality of evaporators heating and evaporating said working medium, a condenser formed below each of said plurality of evaporators, each of said condensers cooling and condensing the vapor of said working medium evaporated by the evaporators, an output part in communication with an end of said main container, said output part converting displacement of a liquid part of said working medium occurring due to fluctuations in a volume of said working medium accompanying evaporation and condensation of said working medium to mechanical energy, a single means for adjusting an internal pressure of said main container, and means for controlling said adjusting means based on a lowest temperature of a temperature of each of said plurality of evaporators.

2. An external combustion engine as set forth in claim 1, wherein said engine further comprises means for detecting the temperatures of each of said plurality of evaporators, and said controlling means judges the lowest temperature among the temperatures of each of said plurality of evaporators.

3. An external combustion engine as set forth in claim 1, wherein said plurality of evaporators are arranged in a flow direction of a high temperature fluid and are supplied with heat from said high temperature fluid, and said controlling means uses a temperature of an evaporator arranged at a downstream most side of said high temperature fluid among said plurality of evaporators as said lowest evaporator temperature.

4. An external combustion engine as set forth in claim 1, wherein said engine further comprises a heat source supplying heat to said plurality of evaporators and means for thermally connecting said plurality of evaporators, and said controlling means uses a temperature of an evaporator with a greatest thermal resistance due to said thermal connecting means among said plurality of evaporators as said lowest evaporator temperature in order to make a peak value of said main container internal pressure lower than a saturated vapor pressure of the working medium of any evaporator temperature.

5. An external combustion engine as set forth in claim 1, wherein said main container has a plurality of branched tubes extending upward from a header tube, and each of said evaporators are formed at an upper end of a respective branched tube.

6. An external combustion engine as set forth in claim 1, further comprising:

a plurality of main containers, each of said evaporators is formed at a respective one of said plurality of main containers, and internal pressures of said plurality of main containers are adjusted by said single adjusting means.

7. An external combustion engine as set forth in claim 1, further comprising:

an auxiliary container in communication with a portion of said main container between said condensers and said output part, said auxiliary container having a liquid sealed inside, and means adjusting an internal pressure of said auxiliary container, wherein said means for adjusting said internal pressure of said main container includes said auxiliary container and said means for adjusting said internal pressure of said auxiliary container.

* * * * *